US007726983B2

(12) United States Patent
Zhu

(10) Patent No.: US 7,726,983 B2
(45) Date of Patent: Jun. 1, 2010

(54) ELECTRICAL CONNECTOR MOUNTED ON EDGE OF PCB

(75) Inventor: Yu Zhu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/152,734

(22) Filed: May 16, 2008

(65) Prior Publication Data

US 2008/0287003 A1 Nov. 20, 2008

(30) Foreign Application Priority Data

May 16, 2007 (CN) ..... 2007 2 0037755

(51) Int. Cl.
*H01R 12/00* (2006.01)

(52) U.S. Cl. ..... 439/79; 439/552

(58) Field of Classification Search ..... 439/79, 439/567, 552, 327

See application file for complete search history.

(56) References Cited

U.S. PATENT DOCUMENTS 5,238,413 A * 8/1993 McCaffrey et al. ..... 439/79
5,980,273 A * 11/1999 Yong et al. ..... 439/79
6,077,093 A * 6/2000 Seong et al. ..... 439/79
6,648,682 B1 * 11/2003 Wu ..... 439/567
6,712,632 B2 * 3/2004 Wu ..... 439/328
6,767,235 B2 7/2004 Wu
2006/0099836 A1 5/2006 Ho

* cited by examiner

*Primary Examiner*—Edwin A. Leon
*Assistant Examiner*—Vanessa Girardi
(74) *Attorney, Agent, or Firm*—Wei Te Chung; Andrew C. Cheng; Ming Chieh Chang

(57) ABSTRACT

An electrical connector comprises an insulative housing, a plurality of terminals assembled to the insulative housing and a pair of fastening elements assembled to the insulative housing. The insulative housing comprises an elongated base portion and a pair of retaining slots respectively disposed at two sides thereof. The base portion defines a mating face and an engaging face opposite to the mating face. A pair of fastening elements are assembled to the pair of retaining slots of the insulative housing, each fastening element comprises a fixing portion received in the retaining slot and a resilient arm disposed outside of the retaining slot and opposite to the fixing portion.

13 Claims, 4 Drawing Sheets

ELECTRICAL CONNECTOR MOUNTED ON EDGE OF PCB

BACKGROUND OF THE INVENTION

1. Field of the Invention

The present invention relates to an electrical connector, and particularly to an electrical connector mounting on a print circuit board.

2. Description of the Prior Art

An electrical connector is usually required to establish a electrical connection between a printed circuit board (PCB) and an electronic device, such as a hard disk drive. Please refer to US patent application publication number 2006/0099836 A1 applied by Ho, Ho discloses an electrical connector adapted to a PCB. Said electrical connector comprises an elongated insulating housing, a plurality of terminals received in the insulating housing and a pair of gaskets positioned at two lateral sides of the insulating housing corresponding to a pair of holes of the PCB. The PCB is usually thin, and accordingly easier to decrease the structural intensity for defining a pair of holes. Differently, U.S. Pat. No. 6,767,235 discloses an electrical connector and introduce a method for preventing destroying the PCB. The insulating housing respectively defines a pair of locking arms at two lateral sides, and therefore a pair of retaining slots can accommodate the PCB. However, the electrical connector is also small to avoid consuming too much space. Accordingly, the locking arms are provided with small form factor. When the PCB is inserted into the retaining slots, the locking arms are also liable to be destroyed, furthermore plastic scraps may be produced to dirty the terminals. Reliable electrical connection will be affected.

Further more, some other methods are employed to overcome the defects, but all fail.

Hence, an improved electrical connector is desired to overcome the disadvantages of the prior art.

BRIEF SUMMARY OF THE INVENTION

Therefore, a main object of the present invention is to provide an electrical connector with simple structure and high efficiency in process of assembly.

To fulfill the above-mentioned object, an electrical connector according to the present invention comprises a insulative housing defining an insulative housing, a plurality of terminals assembled to the insulative housing and a pair of fastening elements assembled to the insulative housing. The insulative housing comprises an elongated base portion and a pair of retaining slots respectively disposed at two sides thereof. The base portion defines a mating face and an engaging face opposite to the mating face. A pair of fastening elements are assembled to the pair of retaining slots of the insulative housing, each fastening element comprises a fixing portion received in the retaining slot and a resilient arm disposed outside of the retaining slot and opposite to the fixing portion.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
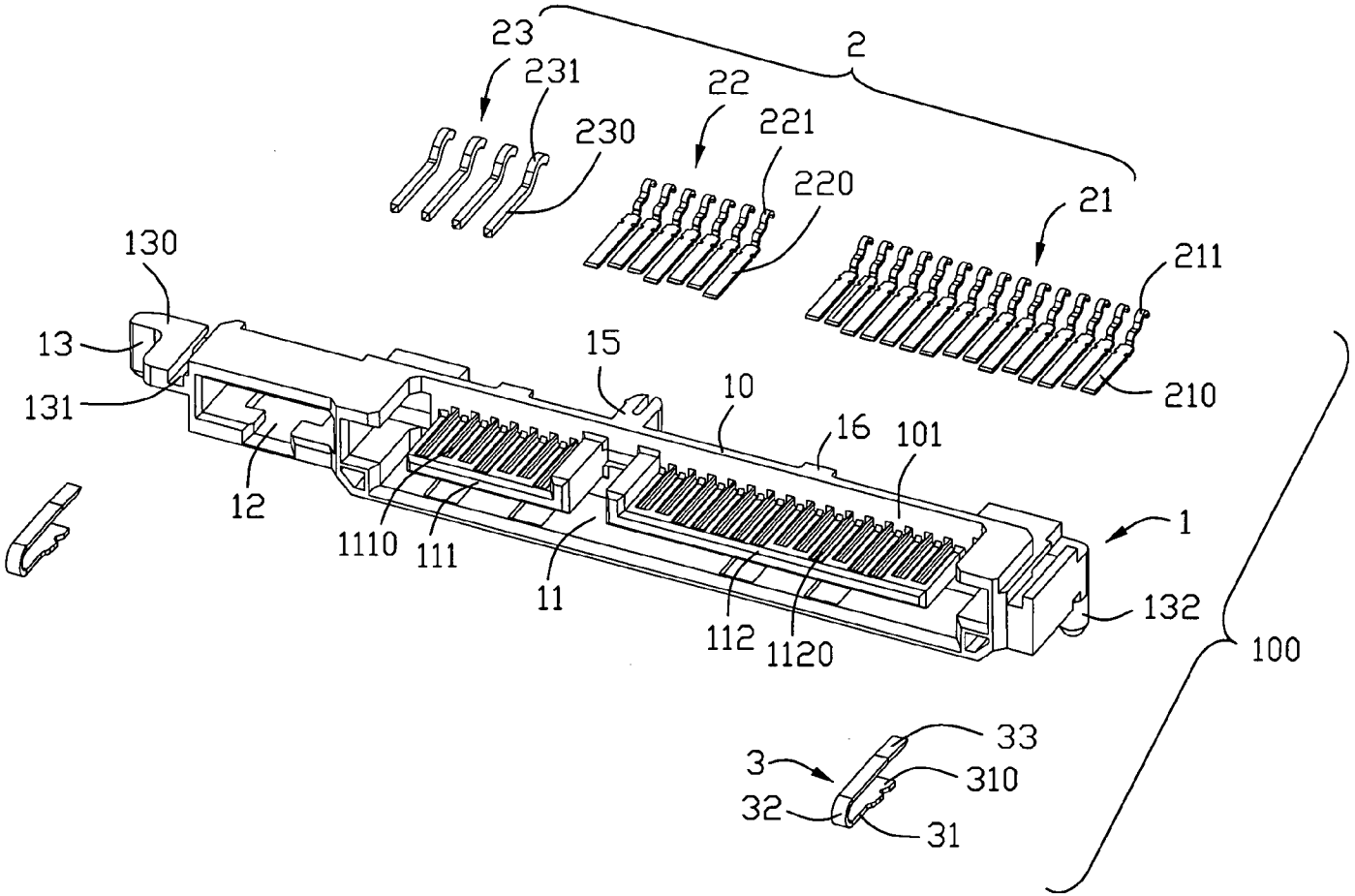
FIG. 1 is an exploded, perspective view of an electrical connector according to the present invention.
Figure 2:
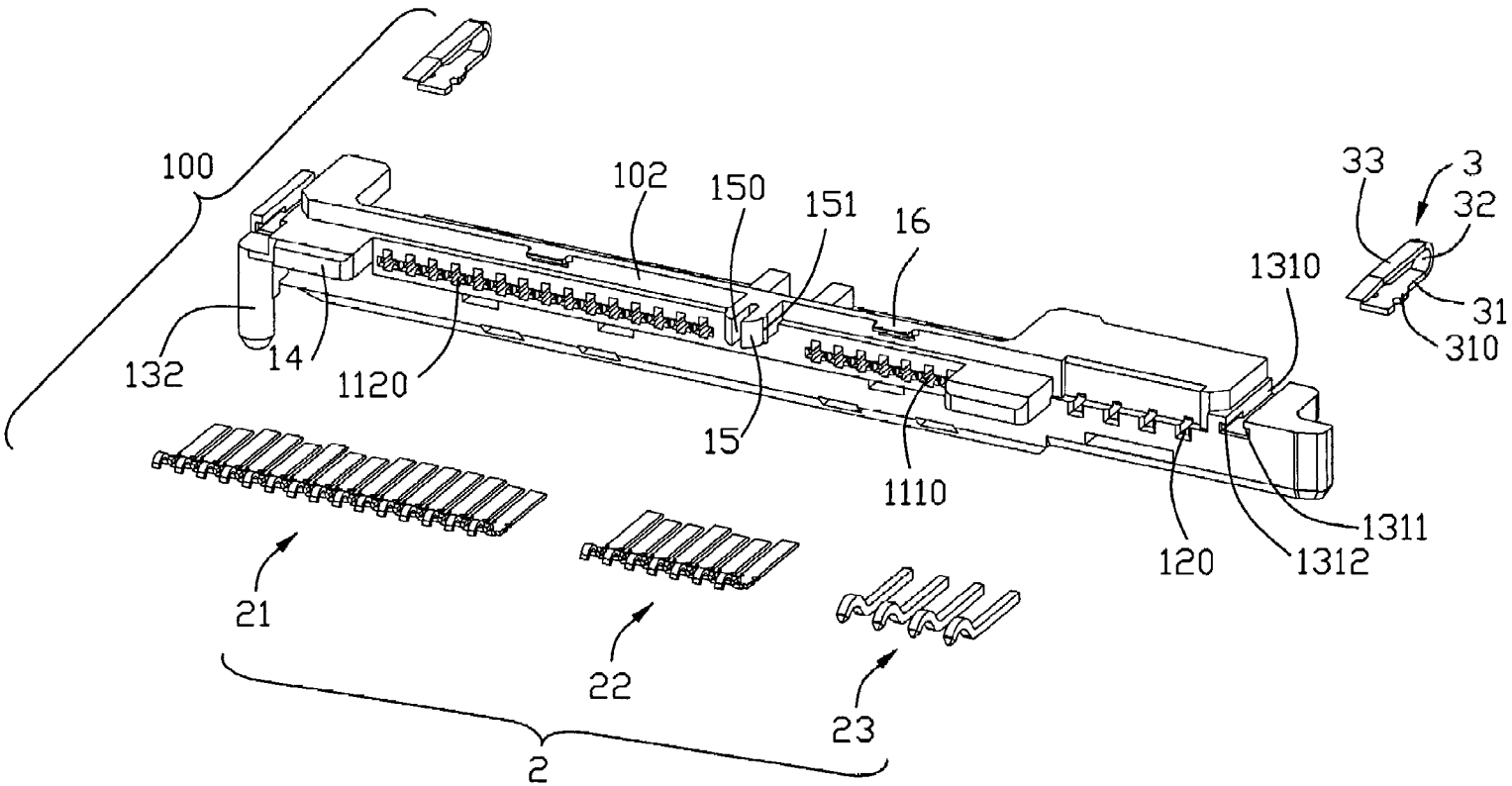
FIG. 2 is an a view similar to FIG. 1, but taken from a different aspect.
Figure 3:
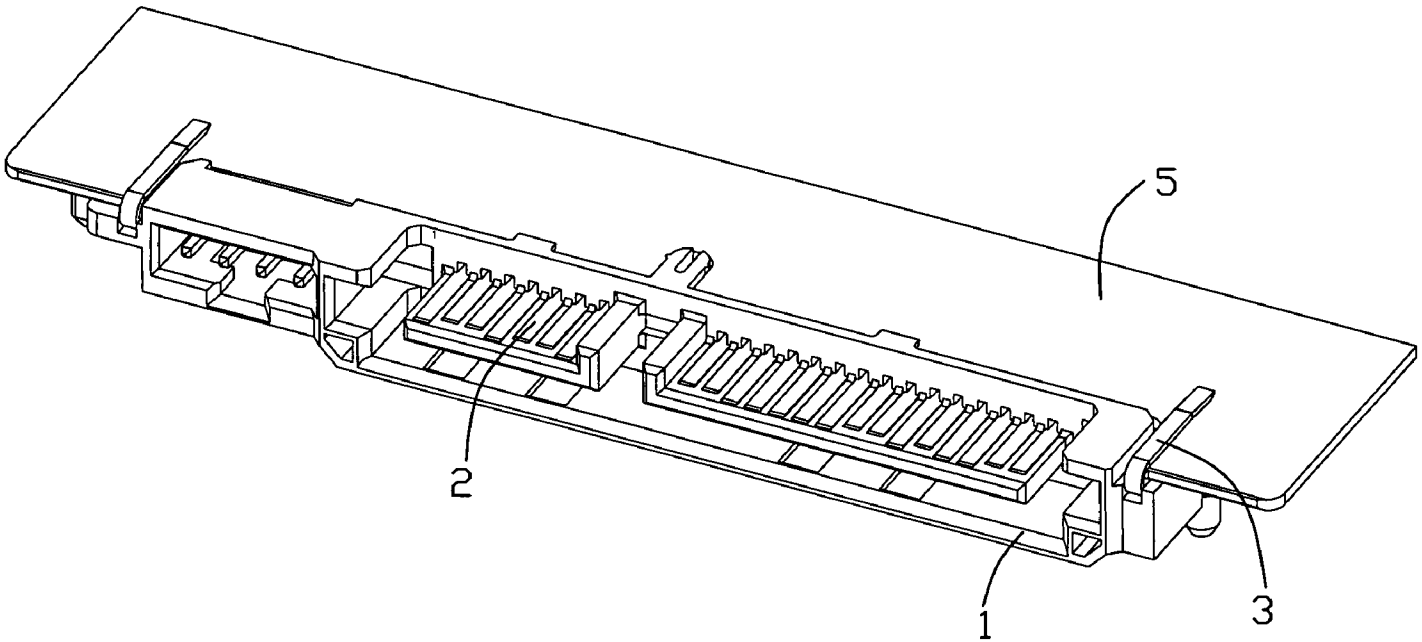
FIG. 3 shows the electrical connector according to the present invention assembled with a print circuit board.
Figure 4:
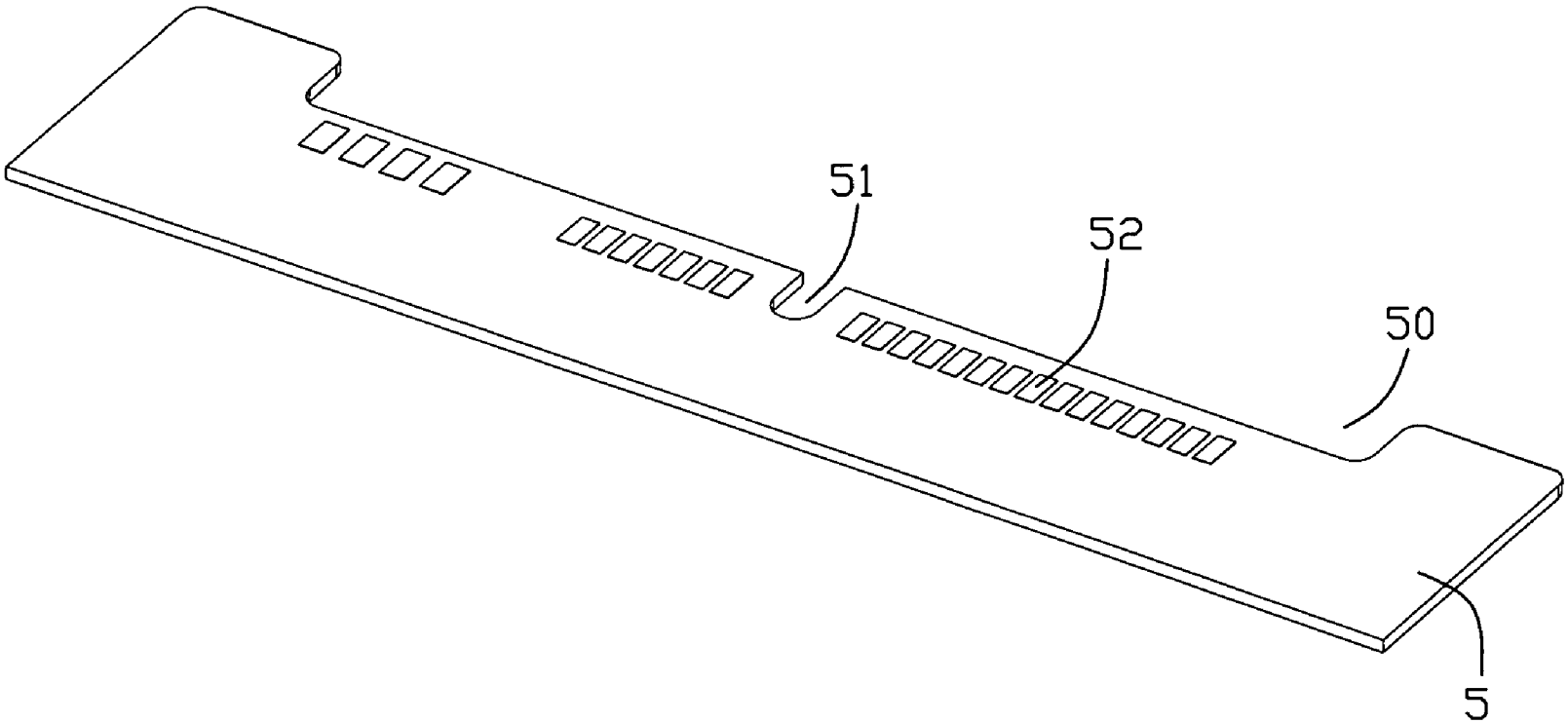
FIG. 4 is a perspective view of the print circuit board.

Referring to FIGS. 1-3, an electrical connector 100 according to the preferred embodiment of the present invention is adapted for mounting on a print circuit board 5. The electrical connector 100 comprises an insulative housing 1, a plurality of terminals 2 disposed therein, a pair of fastening elements 3 located at two sides thereof. The print circuit board 5 defines a plurality of conductive elements 52, a cut-out 50 and a locking slot 51 for engaging with the electrical connector 100.

The insulative housing 1 comprises a substantially elongated base portion 10 and defines a pair of protruding platforms 13 disposed at two sides thereof. The base portion 10 defines a mating face 101 for engaging with a complementary connector and a engaging face 102 opposite to the mating face 101 and engaging with the circuit board 5.

The base portion 10 defines a first receiving portion 11 and a second receiving portion 12 adjacent to the first receiving portion 11 at the side of the mating face 101. The first receiving portion 11 further defines a first accommodating portion 111 and a second accommodating portion 112, respectively forwardly extending from the mating face 101. The first accommodating portion 111 and a second accommodating portion 112 are L shaped tongue portion, respectively defines a plurality of first and second receiving passageways 1110, 1120 extending through the mating face 101 and the engaging face 102. The second receiving portion 12 also defines a plurality of receiving passageways 120 extending through the mating face 101 and the engaging face 102.

Each protruding platform 13 defines an abutment area or supporting face 130 and retaining slot 131 downwardly extending from the supporting face 130. The retaining slot 131 comprises a guiding slot 1310, a positioning groove 1311 longitudinally concaved from two sides of the inner face of the guiding slot 1310 and a pair of positioning blocks 1312. The width of the positioning slot 1311 is larger than that of the guiding slot 1310, accordingly, the retaining slot 131 is of T shape. The protruding platform 13 further defines a post 132 for engaging with a complementary device.

Furthermore, the base portion 10 defines a pair of supporting boards 14 at two sides of the first receiving portion 11, a pair of locking projections 16 spaced from one another and a locking rib 15 locating between the pair of locking projections 16. The pair of supporting boards 14, the locking rib 15 and the pair of locking projections 16 all rearward extend from the engaging face 102. The upper face of the supporting boards 14 is coplanar with the supporting face 130. The upper surface of the locking projections 16 and the locking rib 15 are about coplanar with in a same plane, and all higher than that of the supporting board 14. The locking rib 15 is of fork-type, and comprises a recess 150 and at least a projection 151 protruding from the periphery of the locking rib 15. Therefore, the locking rib 15 is with elasticity.

Each terminal 2 comprises a plurality of first terminals 21 and second terminals 22 received in the first receiving portion 11 and a plurality of third terminals 23 received in the second receiving portion 12. The plurality of first terminals 21 and second terminals 22 are respectively assembled into the first terminal receiving passageways 1110 of the first accommodating portion 111 and the second terminal receiving passageways 1120 of the second accommodating portion 112. The third terminals 23 are assembled into the third terminal receiving passageways 120. Each of the first, second and third terminals 21, 22, 23 comprises a mating portion 210, 220, 230 respectively received in the first and second terminal receiving passageways 1110, 1120 of the first receiving portion 11 and the second receiving portion 12 and a tail portion 211, 221, 231 respectively extending beyond the engaging face 102 for engaging with print circuit board 5.

Each fastening element 3 is U-shaped, and comprises a fixing portion 31 extending horizontally, a resilient aim 33 extending horizontally and opposite to the fixing portion 31 and a U-shaped connecting portion 32 connecting with the fixing portion 31 and the resilient arm 33. The fixing portion 31 further defines a plurality of protrusions 310 for engaging with the positioning slot 1311. The pair of fastening elements 3 are assembled with the retaining slot 132 along a direction from the engaging face 102 to the mating face 101 with the fixing portions 31 interferential engaging with the positioning grooves 1311, the resilient arms 33 locating above the retaining slot 131. Under the cooperation between the positioning grooves 1311, the fastening elements 3 are reliably mounted on the insulative housing 1. In preferred embodiment, the fastening elements 3 are made of metal plate. However, the fastening elements 3 are also made of/from other well-elastic materials in an alternative embodiment.

Referring to FIG. 1-4, in assembly, the print circuit board 5 is moved from one side of the engaging face 102 of the electrical connector 100, with the cut-out 50 engaging with the base portion 10 of the electrical connector 100, the conductive elements 52 electrically connect with tail portions 211, 221, 231 of the first terminals 21, second terminals 22 and third terminals 23, the lower face of print circuit board 5 together supported by the supporting face 130 and a pair of supporting boards 14, the upper surface of the print circuit board 5 effectively positioned by the resilient arms 33. To strengthen the effect of the engagement, the pair of locking projections 16 resists on the upper surface of the print circuit board 5, the locking rib 15 interferential locks with the locking slot 51. Thus, the electrical connector 100 can easily assemble with the circuit board 5 in a snap-locking manner. Furthermore, the fastening elements 3 with simple structure are easy to be mass produced.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having an elongated base portion and a pair of retaining slots respectively disposed at two sides thereof, the base portion defining a mating face and an engaging face opposite to the mating face;

a plurality of terminals assembled to the insulative housing;

a pair of fastening elements assembled to the pair of retaining slots of the insulative housing along an inserting direction from the engaging face toward the mating face, each fastening element comprising a fixing portion received in the retaining slot, a connecting portion connecting with the fixing portion at an end adjacent to the mating face and a resilient arm extending out the insulative housing from the connecting portion and extending along a direction toward the engaging face;

wherein the fastening elements are made of metal plate, the fixing portion, the connecting portion and the resilient arm forming a U-shape.

2. The electrical connector as claimed in claim 1, wherein the fixing portion of the fastening element comprises a plurality of protrusions, each retaining slot comprises a guiding slot and positioning groove communicating with the guiding slot, the plurality of protrusions interferential engage with the positioning groove.

3. The electrical connector as claimed in claim 2, wherein the width of the positioning groove is larger than that of the guiding slot along a longitudinal direction, therefore, the retaining slot is of T-shape.

4. An electrical connector, comprising:

an insulative housing defining an abutment area, at least a retaining slot at two sides thereof, a first receiving portion and a second receiving portion adjacent to the first receiving portion;

a plurality of terminals assembled to the insulative housing, and comprising a plurality of first and second terminals received in the first receiving portion and third terminals received in the second receiving portion;

at least a fastening element assembled to the insulative housing, comprising a fixing portion received in the retaining slot and a resilient arm disposed outside of the retaining slot and opposite to the fixing portion;

a gap defined between the abutment area and the resilient arm allowing an edge of a PCB can be sandwiched therein;

wherein each the fastening element comprises a connecting portion connecting with the fixing portion and the resilient arm, the fixing portion, the connecting portion and the resilient arm forming a U-shape.

5. The electrical connector as claimed in claim 4, wherein the first receiving portion defines a first accommodating portion and a second accommodating portion adjacent to the first accommodating portion.

6. The electrical connector as claimed in claim 4, wherein the fixing portion of the fastening element comprises a plurality of protrusions, each retaining slot comprises a guiding slot and positioning groove communicating with the guiding slot, the plurality of protrusions interferential engage with the positioning groove.

7. The electrical connector as claimed in claim 6, wherein the width of the positioning groove is larger than that of the guiding slot along a longitudinal direction, therefore, the retaining slot is of T-shape.

8. An electrical connector assembly comprising:

an elongated insulative housing defining a longitudinal slot therein;

a plurality of contacts disposed in the housing and exposed in the slot;

a clamping type fastening device mounted to housing, said fastening device defining a first arm fastened to and positioned within the housing; and a printed circuit board defining opposite first and second surfaces, wherein the housing defines an abutment area abutting against the first surface, and said fastening device further defines a second arm seated upon the second surface so as to cooperate with said abutment area to sandwich said printed circuit board therebetween; wherein said abutment area abuts against the first surface of the printed circuit board in an inflexible manner while said second arm abuts against the second surface of the printed circuit board in a flexible manner.

9. The electrical connector assembly as claimed in claim 8, wherein the contacts are seated upon a mating tongue and exposed to an exterior in a direction along which said abutment area faces.

10. The electrical connector assembly as claimed in claim 8, wherein the fastening device is made of metal plate, which comprises a connecting portion having a pair of opposite ends respectively connecting with the first arm and second arm.

11. The electrical connector assembly as claimed in claim 8, wherein said fastening device defines a U-shaped connection portion which connects said first and said confronts the printed circuit board in a front-to-back direction.

12. The electrical connector assembly as claimed in claim 8, wherein said printed circuit board defines an elongated notch along an edge, which confronts the housing, and in said fastening device, so as to receive a portion of the housing.

13. The electrical connector assembly as claimed in claim 12, wherein the printed circuit board further defines a slot extending inwardly from the edge to receive a locking rib which extends from the housing for retention consideration.

* * * * *